US012611047B2

(12) United States Patent
Ando

(10) Patent No.: US 12,611,047 B2
(45) Date of Patent: Apr. 28, 2026

(54) MATTRESS AND METHOD FOR PRODUCING MATTRESS

(71) Applicant: AIRWEAVE Inc., Nukata-gun (JP)

(72) Inventor: Tsuyoshi Ando, Aichi (JP)

(73) Assignee: AIRWEAVE INC., Aichi (JP)

( * ) Notice: Subject to any disclaimer, the term of this patent is extended or adjusted under 35 U.S.C. 154(b) by 159 days.

(21) Appl. No.: 18/556,189

(22) PCT Filed: Apr. 13, 2022

(86) PCT No.: PCT/JP2022/017728
§ 371 (c)(1),
(2) Date: Oct. 19, 2023

(87) PCT Pub. No.: WO2022/224895
PCT Pub. Date: Oct. 27, 2022

(65) Prior Publication Data

US 2024/0206640 A1 Jun. 27, 2024

(30) Foreign Application Priority Data

Apr. 22, 2021 (JP) ..... 2021-072530

(51) Int. Cl.
*A47C 27/12* (2006.01)

(52) U.S. Cl.
CPC ..... *A47C 27/121* (2013.01); *A47C 27/122* (2013.01)

(58) Field of Classification Search
CPC ..... A47C 27/121; A47C 27/122; A47C 27/15; A47C 27/12
See application file for complete search history.

(56) References Cited

U.S. PATENT DOCUMENTS

2011/0256369 A1* 10/2011 Switzer ..... A47C 27/001 428/215
2016/0174725 A1* 6/2016 Takaoka ..... A47C 27/006 5/652.1
2018/0147792 A1* 5/2018 Kojima ..... B33Y 40/00
(Continued)

FOREIGN PATENT DOCUMENTS

JP 6-61160 U 8/1994
JP 2006-097223 A 4/2006
WO WO-2018/003456 A1 1/2018

OTHER PUBLICATIONS

International Search Report for International application No. PCT/JP2022/017728 dated Jun. 7, 2022.

*Primary Examiner* — David R Hare
*Assistant Examiner* — George Samuel Gines
(74) *Attorney, Agent, or Firm* — Harness, Dickey & Pierce, P.L.C.

(57) ABSTRACT

A mattress according to the invention is formed from a plurality of layers stacked in a thickness direction thereof, and includes a tactile layer that is positioned on an upper side in use, and a cushion layer that is positioned on a lower side in use. The tactile layer and the cushion layer each contain an elastic body constituted of a filament three-dimensional assembly. The elastic body contained in the cushion layer has a larger resiliency than that of the elastic body contained in the tactile layer, and is 100 N or more and 200 N or less. The elastic body contained in the tactile layer has a resiliency of 10 N or more and 80 N or less. The tactile layer shows a constant sinking displacement regardless of load.

4 Claims, 4 Drawing Sheets

(56) References Cited

U.S. PATENT DOCUMENTS

| | | | | |
|---|---|---|---|---|
| 2019/0125092 | A1* | 5/2019 | Ando | D04H 3/16 |
| 2020/0315365 | A1* | 10/2020 | Kondo | B32B 5/262 |
| 2020/0360210 | A1* | 11/2020 | Zoni, III | A47C 27/148 |

* cited by examiner

MATTRESS AND METHOD FOR PRODUCING MATTRESS

CROSS-REFERENCE TO RELATED APPLICATIONS

This application is a national phase under 35 U.S.C. § 371 of PCT International Application No. PCT/JP2022/017728 which has an International filing date of Apr. 13, 2022, which claims priority to Japanese Patent Application No. 2021-072530, filed Apr. 22, 2021, the entire contents of each of which are hereby incorporated by reference.

TECHNICAL FIELD

The invention relates to a mattress having a plurality of layers stacked and a method for producing a mattress.

BACKGROUND ART

In recent years, as a mattress that is superior in air permeability and that allows for easy tossing and turning of the body, a high-resilience mattress including a filament three-dimensional assembly (three-dimensional network structure) used as a cushioning material has attracted attention. The filament three-dimensional assembly is obtained, for example, by extruding a thermoplastic resin material, such as polyethylene or polypropylene, from an extruder through a plurality of discharge holes into a continuous line form (a filament form), entangling the filaments with one another in a three-dimensional net form to assemble (fusion-bond) the filaments, and taking the assembly of a three-dimensional net form in the state as it is using a conveyer provided in cooling water to rapidly cool the assembly. The filament three-dimensional assembly has a higher porosity (a typical porosity is 90% or more) as compared with another cushioning material, such as polyurethane foam, and thus, has a superior air permeability. Due to such characteristics, the filament three-dimensional assembly is superior in diffusion of water vapor, and hence, the stuffiness (increase in humidity) in the bed (a space between the mattress and a coverlet) due to perspiration can be suppressed. Thus, the filament three-dimensional assembly is known to have an effect of enhancing the quality of sleep without inhibiting a decrease in core body temperature immediately after the onset of sleep. The filament three-dimensional assembly is also characterized in that, since the hardness (resiliency) can be varied in the thickness direction, it is possible, in a mattress including the filament three-dimensional assembly, to vary the hardness (resiliency) of the mattress in the mattress thickness direction so that an upper layer part of the mattress is soft whereas a lower layer part of the mattress is hard, thereby achieving both of the body pressure dispersibility and the bottoming prevention (see, for example, Patent Documents 1 and 2).

CITATION LIST

Patent Literature

Patent Literature 1: Japanese Unexamined Patent Publication JP-A 2006-97223

Patent Literature 2: Japanese Unexamined Utility Model Publication JP-U 6-61160 (1994)

SUMMARY OF INVENTION

Technical Problem

However, when a mattress 100 having a relatively lower resiliency (relatively softer mattress) (particularly in an upper layer part thereof) is used for enhancing the body pressure dispersibility, as shown in FIG. 5, there are problems in that the sinking displacement of the buttocks increases so that the tossing and turning of the body is difficult and furthermore, the bottoming feeling is likely to occur. On the other hand, when a mattress 101 having a relatively higher resiliency (relatively harder mattress) (particularly in an upper layer part thereof) is used for making the tossing and turning easier, as shown in FIG. 6, the contact area between the body and the mattress upper surface decreases and the area in which the body and the mattress upper surface are not in contact increases. As a result, the air easily flows through the space between the body and the mattress upper surface, and thus, there is a problem in that the heat retention and the sense of embrace (enfolded feeling) are impaired.

An object of the invention is to provide a mattress that suppresses an increase in humidity in the bed due to perspiration, that can reduce the sinking displacement of the buttocks, and that is superior in the heat retention and the sense of embrace, and a method for producing a mattress.

Solution to Problem

A mattress of the disclosure includes

- a tactile layer that is positioned on an upper side in use, and
- a cushion layer that is positioned on a lower side in use,
- the tactile layer and the cushion layer each containing an elastic body constituted of a filament three-dimensional assembly,
- the elastic body contained in the cushion layer having a resiliency of 100 N or more and 200 N or less,
- the elastic body contained in the tactile layer having a resiliency of 10 N or more and 80 N or less,
- the tactile layer showing a constant sinking displacement regardless of load.

In the mattress of the invention, the tactile layer has a thickness of 8 mm or more and 30 mm or less.

In the mattress of the invention, the elastic body contained in the tactile layer is a filament three-dimensional assembly formed of a styrene-based elastomer.

In the mattress of the invention, the elastic body contained in the cushion layer is a filament three-dimensional assembly formed of a polyester-based elastomer.

A method for producing a mattress of the invention is a method for producing a mattress, the mattress including

- a tactile layer that is positioned on an upper side in use, and
- a cushion layer that is positioned on a lower side in use,
- the tactile layer and the cushion layer each containing an elastic body constituted of a filament three-dimensional assembly,
- the elastic body contained in the cushion layer having a resiliency of 100 N or more and 200 N or less,
- the elastic body contained in the cushion layer having a thickness of 8 mm or more and 30 mm or less,
- the elastic body contained in the tactile layer having a resiliency of 10 N or more and 80 N or less,
- the elastic body contained in the tactile layer having a thickness of 50 mm or more and 250 mm or less, the method including a step of selecting, as the elastic body contained in the tactile layer, an elastic body that provides a difference in sinking displacement between the shoulder and the buttocks of 0 mm or more and 5 mm or less when a user lies on the back on the elastic body.

Advantageous Effects of Invention

The mattress of the invention includes, on an upper side of the cushion layer having a resiliency as high as 100 N or more and 200 N or less, a tactile layer that functions as an elastic body that provides a constant sinking displacement regardless of load. The lower the resiliency of the cushion layer is, due to the difference in weight (difference in load), for example, between the shoulder and the buttocks, the more the difference in sinking displacement between the shoulder and the buttocks is likely to occur. The tactile layer in the invention shows a constant sinking displacement regardless of the difference in load. By providing the tactile layer in a superposing manner on the upper side of the cushion layer having a resiliency as high as 100 N or more and 200 N or less, although the sinking displacement as the tactile layer is large, the difference in sinking displacement between the buttocks and the shoulder due to the difference in load therebetween can be reduced. Accordingly, a mattress that is superior in the heat retention and the sense of embrace, that shows a lower sinking displacement of the buttocks, that suppresses stuffiness (increase in humidity) in the bed due to perspiration, and that is superior in the body pressure dispersibility and the bottoming prevention can be achieved.

Since the elastic body contained in the tactile layer has a resiliency of 10 N or more and 80 N or less, filaments have been successfully stably melt-bonded to one another, and thus, the variation in resiliency can be suppressed, and the thickness can be kept constant even after long-term use. As a result, even if a high-resilience cushion layer is present on the lower side, a mattress that is superior in the body pressure dispersibility and the bottoming prevention can be achieved without impairing the heat retention and the sense of embrace.

Since the tactile layer has a thickness of 8 mm or more and 30 mm or less, even if a high-resilience cushion layer is present on the lower side, a mattress that has a good balance between the body pressure dispersibility and the bottoming prevention can be achieved without impairing the heat retention and the sense of embrace.

BRIEF DESCRIPTION OF DRAWINGS

The object, characteristics, and advantages effects of the invention will be clearer from the following detailed description and drawings.

DESCRIPTION OF EMBODIMENTS

Suitable embodiments of the invention will be described in detail below with reference to the drawings.

(Mattress 1)

Figure 1:
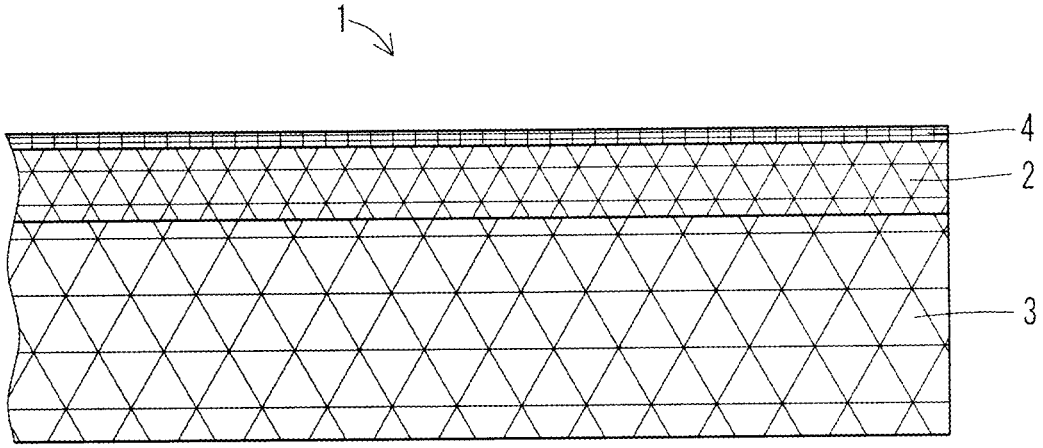
FIG. 1 is a sectional side view of a mattress according to a first embodiment of the invention.

FIG. 1 is a sectional side view of a mattress according to a first embodiment of the invention. In FIG. 1, a mattress 1 according to the embodiment is composed of three layers. The mattress 1 includes a tactile layer 2 that is positioned on the upper side in use and a cushion layer 3 that is positioned on the lower side in use, and the upper side of the tactile layer 2 is covered with a cover layer 4. The tactile layer 2 and the cushion layer 3 each contain an elastic body constituted of a filament three-dimensional assembly.

The cushion layer 3 is a relatively harder (higher resiliency-having) layer and can suppress sinking of the buttocks giving a larger load, and thus, a user can achieve a lying posture close to an erect posture and at the same time, both the body pressure dispersibility and the bottoming prevention can be achieved.

When a mattress is composed only of the cushion layer 3, the sinking displacement itself is small, and thus, the heat retention and the sense of embrace are impaired. The tactile layer 2 is a relatively softer (lower resiliency-having) layer, and even if there is a difference in load, for example, among the shoulder, the buttocks, the legs, and the like of a user, the sinking displacement is constant in the layer (in a state in which the layer is substantially completely compressed), and a user can obtain the heat retention and the sense of embrace. In the mattress 1 of the invention, by providing the tactile layer 2 in a superposing manner on the upper side of the cushion layer 3, the mattress 1 that is superior in the body pressure dispersibility and the bottoming prevention can be achieved without impairing the heat retention and the sense of embrace. In the tactile layer 2, the sinking displacement is simply to be constant (in a state in which the layer is substantially completely compressed) among the shoulder, the buttocks, the legs, and the like regardless of load when the loads are larger than a prescribed value. For example, when the load on the tactile layer 2 in the thickness direction increases so that the layer is compressed into a prescribed thickness (substantially completely compressed), the sinking displacement is constant at a load larger than the load at this time, and thus, a phenomenon that the lying posture of a user becomes a laterally extending "V-shape" posture due to sinking of the buttocks, as caused in a mattress composed only of a relatively softer (lower resiliency-having) layer, can be prevented.

The tactile layer 2 and the cushion layer 3 each contain an elastic body constituted of a filament three-dimensional assembly superior in air permeability. In order to secure the air permeability also in a state in which the tactile layer 2 is completely compressed, the air permeability of the tactile layer 2 when the tactile layer 2 is compressed with a load of 200 N using a rod-shaped pressure member (load rod) at a tip portion of which a circular plate with a diameter of 150 mm is horizontally provided, the circular plate having circular holes with an inner diameter of 5 mm provided at intervals of 5 mm, is preferably 50 $cm^3/cm^2 \cdot s$ or more and 500 $cm^3/cm^2 \cdot s$ or less. With the air permeability of less than 50 $cm^3/cm^2 \cdot s$, the inside of the bed tends to get stuffy, and with the air permeability of exceeding 500 $cm^3/cm^2 \cdot s$, the strength tends to be impaired.

(Tactile Layer 2)

The tactile layer 2 of the invention preferably has a thickness of 8 mm or more and 30 mm or less. With the thickness of less than 8 mm, the heat retention and the sense of embrace are difficult to achieve, and with the thickness of exceeding 30 mm, the tossing and turning is difficult due to an increased rolling resistance. The thickness is further preferably 10 mm or more and 25 mm or less. With the thickness of 10 mm or more and 25 mm or less, the sense of embrace and the easiness of tossing and turning are both achieved at high levels.

In the invention, as described above, the tactile layer 2 shows a constant sinking displacement regardless of load, and the constant sinking displacement encompasses the case where a difference in sinking displacement, if present, is very small. The tactile layer 2 is specifically a layer in which the difference of a thickness T1 and a thickness T2, namely T1−T2, is 0 mm or more and 5 mm or less and the resiliency is 10 N or more and 80 N or less, wherein the thickness T1 is a thickness of the layer when the tactile layer 2 is compressed with a load of 100 N using a rod-shaped pressure member (load rod) at a tip portion of which a circular plate with a diameter of 150 mm is horizontally provided and the thickness T2 is a thickness of the layer when the tactile layer 2 is compressed with a load of 200 N using the load rod. By setting the resiliency of the tactile layer 2 within the above range, the difference in sinking displacement between the shoulder and the buttocks in the tactile layer 2 can be reduced. Furthermore, it is further preferred that the difference in thickness, T1−T2, is 3 mm or less and the resiliency is 20 N or more and 50 N or less. By setting the resiliency of the tactile layer 2 within the above range, the differences in sinking displacement between the shoulder and the buttocks and between the heels and the buttocks can be reduced.

The elastic body constituted of a filament three-dimensional assembly contained in the tactile layer 2 has a resiliency of 10 N or more and 80 N or less, and further preferably 20 N or more and 50 N or less. The resiliency of the elastic body constituted of a filament three-dimensional assembly can be easily adjusted by adjusting the density of filaments.

Examples of the method for reducing the density of filaments include a method in which the hole diameter of nozzle holes in a production apparatus of the filament three-dimensional assembly is reduced to reduce the diameter of the filaments, a method in which the number of the nozzle holes per unit area in a production apparatus of the filament three-dimensional assembly is increased to reduce the number of the filaments per unit volume, and/or a method in which the conveying velocity of the filament three-dimensional assembly is increased to reduce the volume of the filaments per unit volume.

When the resiliency is less than 10 N, the filament diameter of the filament three-dimensional assembly has to be excessively decreased, and thus, it is difficult to stably melt-bond the filaments to one another so that a variation in resiliency is likely to occur. In addition, when the filament diameter is excessively decreased, it is difficult to keep the thickness, the resiliency, and the like through long-term use and the so-called permanent set in fatigue is likely to occur. When the resiliency exceeds 80 N, the heat retention and the sense of embrace are difficult to achieve due to gaps generated between the tactile layer 2 and a user.

When the tactile layer 2 containing an elastic body having a resiliency of 10 N or more and 80 N or less is provided on the upper side of the cushion layer 3, the mattress 1 that is superior in the heat retention and the sense of embrace, that shows a small sinking displacement of the buttocks, that suppresses the stuffiness (increase in humidity) in the bed due to perspiration, and that is superior in the body pressure dispersibility and the bottoming prevention can be achieved.

The resiliency in the invention can be measured by the following method.

First, a sample to be measured is placed on a horizontal table, the thickness of the sample not compressed is measured and is taken as L1 (mm). Then, a rod-shaped pressure member (load rod) a tip portion of which a circular plate with a diameter of 150 mm is horizontally provided is vertically brought into contact with the central portion of the upper surface of the sample, and a load is applied to the load rod to compress the sample in the thickness direction. Then, as the thickness of the compressed sample, the distance L2 (mm) between the bottom surface of the sample (horizontal table upper surface) and the tip of the load rod (circular plate) is measured. The load when L2 is 7.5 mm smaller than the thickness L1 (mm) of the non-compressed sample (L2=L1−7.5) is measured as a value including the weight of the load rod, and the value (N) is taken as the resiliency.

In the mattress 1 of the invention, the elastic body contained in the tactile layer 2 is a filament three-dimensional assembly formed of at least one of a polyolefin-based elastomer, a polyester-based elastomer, and a styrene-based elastomer.

In the mattress 1 of the invention, the elastic body contained in the tactile layer 2 is preferably a filament three-dimensional assembly of a styrene-based elastomer. Since a styrene-based elastomer has a softness close to that of a rubber, the resiliency can be reduced to achieve a soft touch without excessively decreasing the filament diameter of the filament three-dimensional assembly. When the elastic body contained in the tactile layer 2 is a filament three-dimensional assembly of a styrene-based elastomer, the tactile layer 2 easily functions as a layer showing a very small difference in sinking displacement by the difference in body pressure.

The resiliency of the tactile layer 2 can be adjusted according to the body shape of a user. Specifically, a method for producing a mattress preferably includes a step of preparing several kinds of elastic bodies respectively constituted of filament three-dimensional assemblies having different resiliencies and thicknesses, and selecting, as the elastic body of the tactile layer 2, an elastic body of a filament three-dimensional assembly having a resiliency and a thickness such that the difference in sinking displacement between the shoulder and the buttocks when a user lies on the back (in a spine position) on the elastic body is 0 mm or more and 5 mm or less.

It is further preferred to employ an elastic body as the tactile layer 2 so as to provide differences in sinking displacement between the shoulder and the buttocks and between the heels and the buttocks of 3 mm or less.

When a plurality of elastic bodies can be employed as the tactile layer 2, the elastic body may be determined according to the preference of the user in view of the rolling resistance in the tossing and turning and the sense of embrace.

Another method for producing a mattress preferably includes a step of measuring divided body weights of the shoulder, the buttocks, and the like of a user, and with reference to the divided weigh bodies, selecting, as the elastic body of the tactile layer 2, an elastic body of a filament three-dimensional assembly that has a resiliency and a thickness such that the difference in sinking displacement between the shoulder and the buttocks is 0 mm or more and 5 mm or less.

(Cushion Layer 3)

The cushion layer 3 is a cushion main body of the mattress 1 of the invention, contains an elastic body constituted of a filament three-dimensional assembly, and is disposed on the lower side of the tactile layer 2 to contribute to the body pressure dispersibility and the bottoming prevention.

The elastic body constituted of a filament three-dimensional assembly contained in the cushion layer 3 has a resiliency larger than the resiliency of the tactile layer 2, and, for example, has a resiliency of 100 N or more and 200 N or less. With the resiliency of less than 100 N, the sinking displacement of the buttocks increases, leading to difficulty of the tossing and turning. On the other hand, with the resiliency of exceeding 200 N, the body pressure dispersibility is reduced, leading to poor feeling in bed. The thickness of the cushion layer 3 is larger than the thickness of the tactile layer 2 and, for example, is 50 mm or more and 250 mm or less. When the thickness of the cushion layer 3 is less than 50 mm, the body pressure dispersibility and the bottoming prevention are likely to deteriorate, whereas with the thickness of the cushion layer 3 of exceeding 250 mm, it is difficult to carry the mattress.

It is preferred to adjust the thickness of the elastic body contained in the cushion layer 3 into 100 mm or more and 250 mm or less, the resiliency of the elastic body contained in the cushion layer 3 into 100 N or more and 200 N or less, the difference in sinking displacement between the shoulder and the buttocks when a user lies on the back on the elastic body contained in the cushion layer 3 into 0 mm or more and 5 mm or less, the thickness of the elastic body contained in the tactile layer 2 into 10 mm or more and 50 mm or less, the resiliency of the tactile layer into 10 N or more and 50 N or less, and the difference in sinking displacement between the shoulder and the buttocks when a user lies on the back on the elastic body contained in the tactile layer 2 into 0 mm or more and 5 mm or less, according to the user. The elastic bodies contained in the cushion layer 3 and the tactile layer 2 each may be an elastic body that is continuous in the stature direction or an elastic body that can be divided.

In another embodiment, the elastic body of the cushion layer 3 may have a configuration in which a plurality of elastic bodies respectively constituted of filament three-dimensional assemblies having different resiliencies are stacked in the thickness direction (vertical direction).

The mattress 1 of the invention is a mattress in which the elastic body contained in the cushion layer 3 is a filament three-dimensional assembly formed of at least one of a polyolefin-based elastomer, a polyester-based elastomer, and a styrene-based elastomer.

It is further preferred that the elastic body contained in the cushion layer 3 is a filament three-dimensional assembly formed of a polyester-based elastomer.

Specifically, in the mattress 1 of the invention, the elastic body contained in the tactile layer 2 is preferably a filament three-dimensional assembly formed of a styrene-based elastomer and the elastic body contained in the cushion layer 3 is preferably a filament three-dimensional assembly formed of a polyester-based elastomer.

The filament three-dimensional assembly formed of a polyester-based elastomer is likely to emit a bursting sound which is emitted when filaments burst in the tossing and turning, but the emission of the bursting sound is suppressed by using the filament three-dimensional assembly formed of a styrene-based elastomer in the tactile layer 2 on the upper side. In addition, since a polyester-based elastomer is easily hydrolyzed, there is a problem in that the resiliency is decreased due to hydrolysis when the humidity of the mattress upper surface increases due to perspiration. However, the decrease in resiliency can be prevented by using a filament three-dimensional assembly formed of a polyester-based elastomer in the cushion layer 3 on the lower side. Accordingly, by the mattress 1 having a configuration of such a combination as above, a mattress more superior in the body pressure dispersibility and the bottoming prevention can be achieved without impairing the heat retention and the sense of embrace.

Furthermore, in the mattress 1 of the invention, the cushion layer 3 preferably contains elastic bodies respectively constituted of filament three-dimensional assemblies having different resiliencies along the stature direction of a human body (the longitudinal direction of the cushion layer). For example, the elastic body of the cushion layer 3 may have such a configuration that the elastic body can be divided into three parts of the shoulder, the buttocks, and the legs, or more parts in which the resiliencies of the elastic body are set into different resiliencies. The cushion layer 3 is further preferably formed so that the resiliency of the elastic body at a position that supports the buttocks is higher than the resiliency of the elastic body at a position that supports the shoulder. By the cushion layer 3 as above being positioned below the tactile layer 2, the mattress 1 that is superior in the heat retention and the sense of embrace, that shows a small sinking displacement of the buttocks, that suppresses the stuffiness (increase in humidity) in the bed due to perspiration, and that is further superior in the body pressure dispersibility and the bottoming prevention can be achieved.

(Cover Layer 4)

The cover layer 4 may be provided on the upper surface of or on the upper surface and the lower surface of the tactile layer 2. In the cover layer 4, a fabric, such as a woven or knitted fabric, is suitably used.

The cloth of the cover layer 4 is not particularly limited as long as air permeability can be secured, and, for example, a pile cloth knitted with a polyester yarn, a nylon yarn, or an acryl yarn, a jacquard knitted cloth, a double raschel cloth, a quilt cloth, or the like can be used.

The cover layer 4 may be, for example, in the form of sheet, in the form of pouch that contains the tactile layer 2, or in the form of pouch that contains the tactile layer 2 and the cushion layer 3, as long as it covers at least the upper surface of the tactile layer 2.

Figure 2:
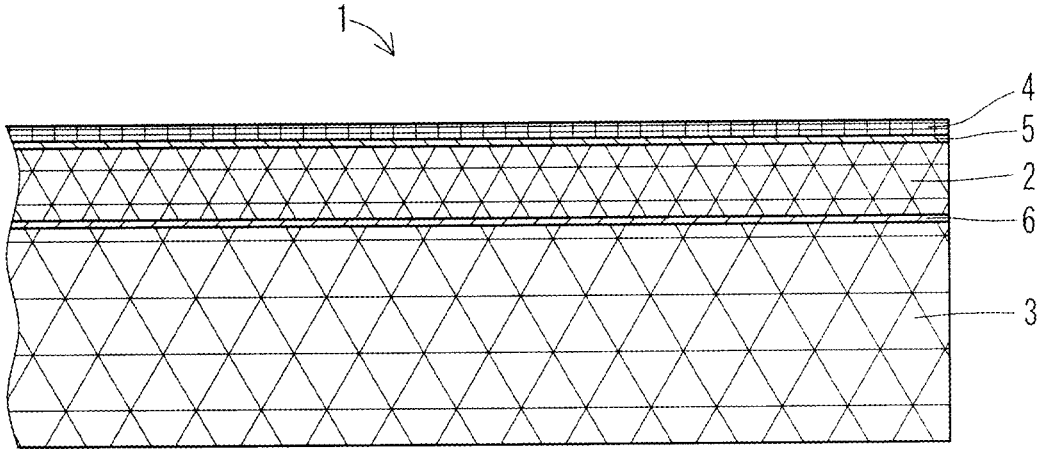
FIG. 2 is a sectional side view of a mattress provided with heat retention cloth layers.

FIG. 2 is a sectional side view of a mattress according to a second embodiment. In the embodiment, a heat retention cloth layer 5 is provided between the tactile layer 2 and the cover layer 4, and a heat retention cloth layer 6 is provided between the cushion layer 3 and the tactile layer 2. By the heat retention cloth layers 5 and 6, the heat retention of the mattress 1 is enhanced. Only one of the heat retention cloth layers 5 and 6 may be provided.

By providing the heat retention cloth layers 5 and 6, air flow from the outside to the inside of the tactile layer 2 or from the inside to the outside of the tactile layer 2 can be suppressed, and thus, the heat retention is enhanced. The heat retention cloth layers 5 and 6 have a thickness smaller than that of the tactile layer 2 and the thickness is preferably 2 mm or more and 9 mm or less. With the thickness of less than 2 mm, filaments having a diameter of several millimeters constituting the tactile layer 2 appear as unevenness on the surfaces of the heat retention cloth layers 5 and 6, leading to poor texture. On the other hand, with the thickness of exceeding 9 mm, the good air permeability of the filament three-dimensional assembly is likely to be impaired, leading to stuffiness.

The air permeability of the heat retention cloth layers 5 and 6 is preferably 1 $cm^3/cm^2 \cdot s$ or more and 50 $cm^3/cm^2 \cdot s$ or less. When the air permeability of the heat retention cloth layers 5 and 6 is 1 $cm^3/cm^2 \cdot s$ or more, the stuffiness in the bed is less likely to occur, whereas with the air permeability of 50 $cm^3/cm^2 \cdot s$ or less, the heat retention is less likely to deteriorate.

The air permeability can be measured using a Frazierr air permeability tester (manufactured by YASUDA SEIKI SEISAKUSHO, LTD.) as defined in JIS L 1096: 1999 "Testing methods for woven and knitted fabrics" 8.27.1A method (Frazierr method).

In the heat retention cloth layers 5 and 6, fabrics of various fibers can be used and acrylate-based fibers are preferably contained. By the heat retention cloth layers 5 and 6 containing acrylate-based fibers, the moisture retention is enhanced. The acrylate-based fibers are obtained by introducing into a polymer obtained from acrylic fibers as a raw material a highly polar ionic group (carboxylic acid salt) for enhancing moisture adsorption.

The acrylate-based fibers having a highly polar ionic group generate a large heat of adsorption in adsorbing water vapor (absorbing moisture), and thus, the water vapor is kept as adsorbed water on the surface of the acrylate-based fibers in a state stabilized in terms of the energy. Since the heat of adsorption of the acrylate-based fibers is about 1000 to 1500 KJ/kg with respect to the heat of vaporization of water which is 2442 KJ/kg, the acrylate-based fibers have high ability to trap water vapor.

The acrylate-based fibers have an ability to trap water vapor generated due to perspiration as adsorbed water to decrease the humidity, which can suppress stuffiness under a high humidity environment. The acrylate-based fibers also have an ability to hold adsorbed water, which can suppress drying under a low humidity drying. By both the above abilities of the acrylate-based fibers, the heat retention cloth layers 5 and 6 have an effect of holding the humidity in the bed constant.

An example of a commercial product of such acrylate-based fibers is MOISCARE (product name, registered trade name) manufactured by Japan Exlan Co., Ltd.

The water content of the acrylate-based fibers is preferably 30% by weight or more and 50% by weight or less at a temperature of 20° C. and a humidity of 65% RH. When the water content of the acrylate-based fibers is 30% by weight or more, an effect of reducing the humidity in the mattress 1 can be sufficiently achieved, and when the water content is 50% by weight or less, the mattress is easily dried.

The water content of fibers can be determined by the following method.

As a sample for water content measurement, about 1 g of fibers are allowed to stand under environmental conditions of a temperature of 20° C. and a humidity of 65% RH for 12 hours for humidification, and the weight of the fibers after humidification is measured. The measured value is taken as a hydroscopic fiber mass Wa (g). Next, the fibers after humidification are allowed to stand in a hot air dryer of 105° C. for 12 hours for drying, and the weight of the fibers after drying is measured. The measured value is taken as a dry fiber mass Wb (g). The water content Wr (%) is calculated with the following formula (1), and the calculated value is taken as the water content of the fibers.

$$Wr = (Wa - Wb)/Wa \times 100 \quad (1)$$

The content of the acrylate-based fibers contained in the heat retention cloth layers 5 and 6 is preferably 10% by weight or more and 30% by weight or less. With the content of 10% by weight or more, sufficient moisture absorption is easily achieved, whereas with the content of 30% by weight or less, drying is easy.

The thickness of acrylate-based fibers is not particularly limited, but the single fiber fineness is preferably 1 dtex or more and 4 dtex or less (about 10 μm or more and 20 μm or less as the fiber diameter). With the single fiber fineness of 1 dtex or more, a sufficient strength tends to be achieved, whereas with the single fiber fineness of 4 dtex or less, a sufficient moisture absorption tends to be achieved with a large surface area.

By using the same material as that of the heat retention cloth layers 5 and 6 as a material of the cover layer 4, the function of the heat retention cloth layers 5 and 6 may be imparted to the cover layer 4. In this case, since the cover layer 4 also acts as the heat retention cloth layers 5 and 6, the heat retention cloth layers 5 and 6 do not have to be used.

Figure 3:
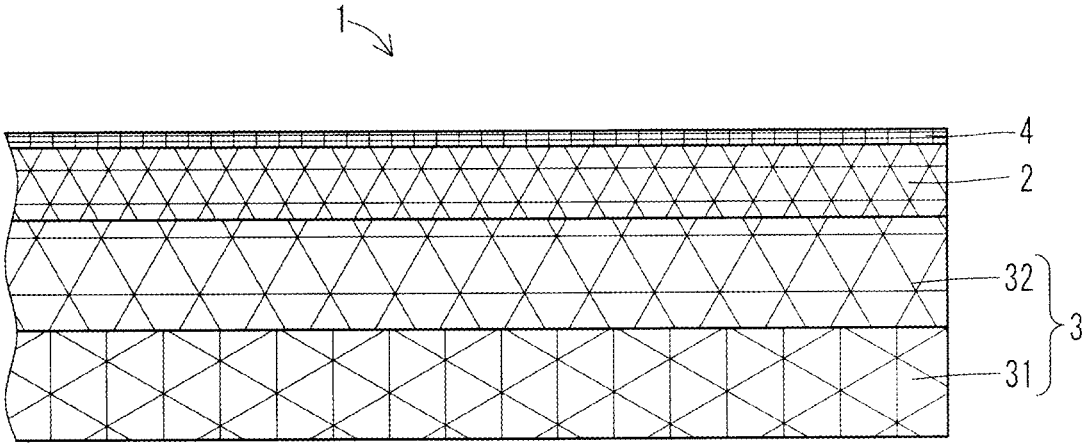
FIG. 3 is a sectional side view illustrating a cushion layer composed of a first cushion layer and a second cushion layer.

FIG. 3 is a sectional side view of a mattress according to a third embodiment. In the embodiment, the cushion layer 3 includes a plurality of layers. In the mattress 1 according to the embodiment, the cushion layer 3 includes a first cushion layer 31 and a second the cushion layer 32 positioned above the first cushion layer 31. The resiliencies of the first cushion layer 31, the second cushion layer 32, and the tactile layer 2 preferably decrease in this order. Thus, the mattress 1 that is more superior in the body pressure dispersibility and the bottoming prevention can be achieved without impairing the heat retention and the sense of embrace.

The cushion layer 3 according to the embodiment has a configuration including two layers, but the invention is not limited thereto and the cushion layer 3 may have a configuration including three or more layers. When three or more layers are included, it is preferred that resiliencies also decrease in the order from the lowermost layer toward the uppermost layer and the resiliency of the tactile layer 2 is further smaller. When three or more layers are included, the layers adjacent to each other in the thickness direction may have the same resiliency.

Figure 4:
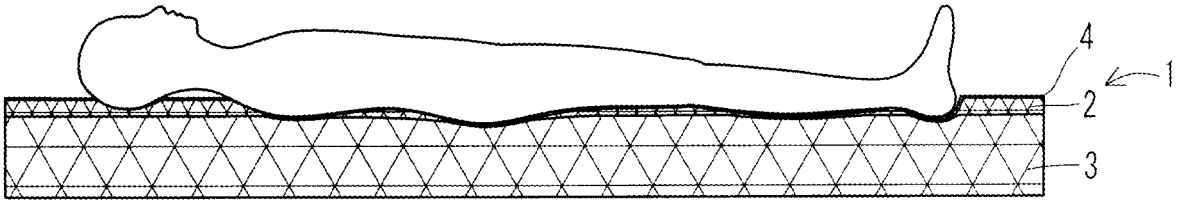
FIG. 4 is a conceptional sectional side view illustrating a state in which a human body lies on the mattress of the invention.
Figure 5:
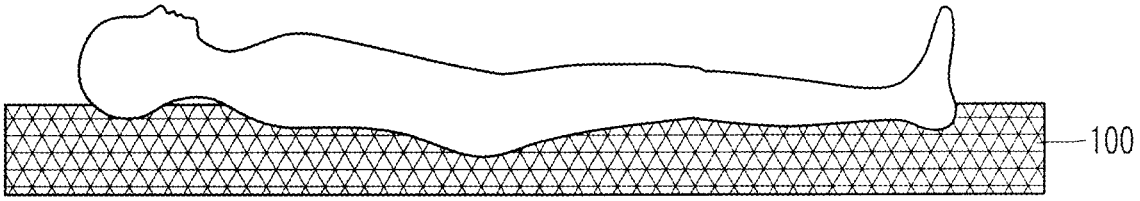
FIG. 5 is a conceptional sectional side view illustrating a state in which a human body lies on a mattress having a low resiliency.
Figure 6:
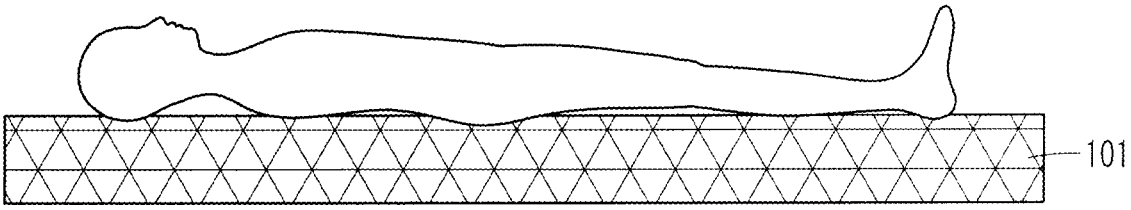
FIG. 6 is a conceptional sectional side view illustrating a state in which a human body lies on a mattress having a high resiliency.

FIG. 4 is a conceptional sectional side view illustrating a state in which a user lies on the mattress of the invention. In FIG. 4, in the tactile layer 2 positioned on the upper side, the parts in contact with the body are compressed to have a thickness of substantially zero (5 mm or less) due to the loads. The body of the user is supported by the cushion layer 3 which is relatively harder (has a relatively larger resiliency). Since the cushion layer 3 is a relatively harder layer, sinking of the buttocks is suppressed, and thus, the user lying on the mattress 1 can achieve a lying posture close to an erect posture. Since there is no gap between the body and the mattress upper surface owing to the tactile layer 2, inward air flow is suppressed and thus, the heat retention and the sense of embrace (enfolded feeling) can be achieved.

Figure 7A:
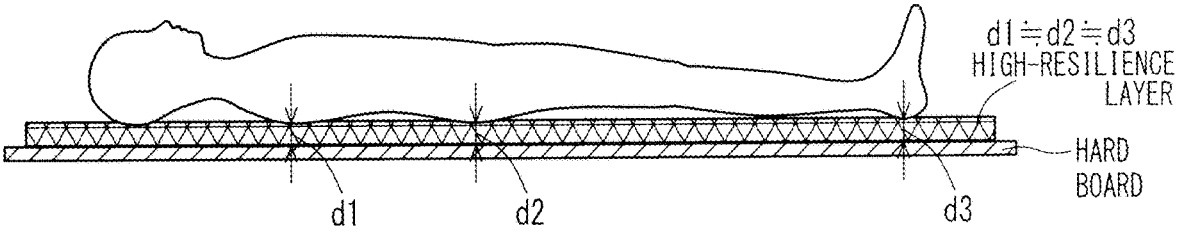
FIG. 7A is a conceptional sectional side view illustrating a sinking state when a human body lies on a high-resilience elastic body.
Figure 7B:
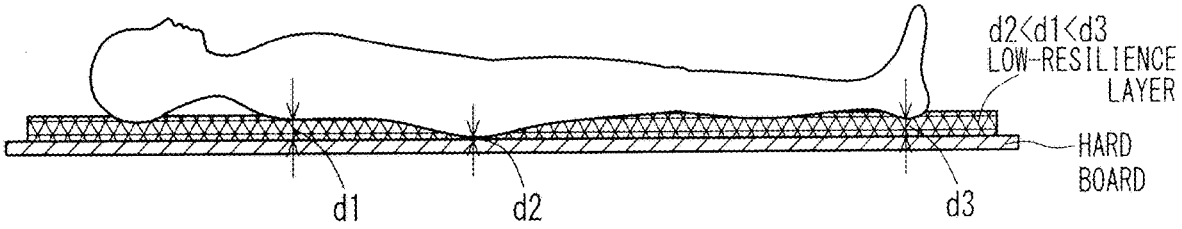
FIG. 7B is a conceptional sectional side view illustrating a sinking state when a human body lies on a low-resilience elastic body.
Figure 7C:
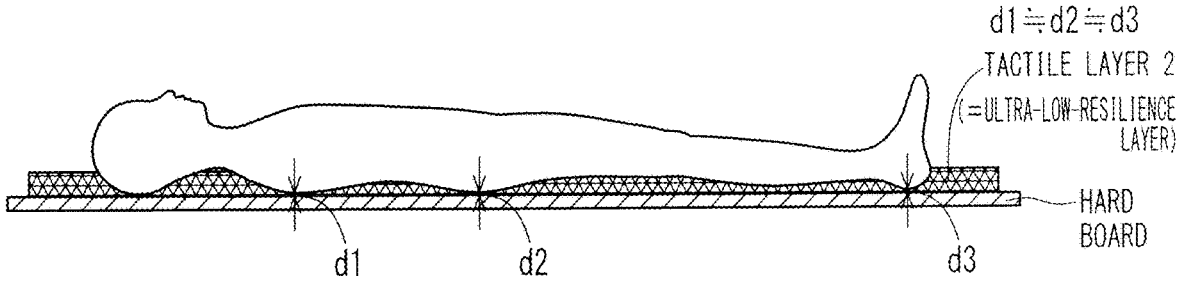
FIG. 7C is a conceptional sectional side view illustrating a sinking state when a human body lies on a tactile layer elastic body.

FIG. 7A is a conceptional sectional side view illustrating a sinking state when a human body lies on a high-resilience elastic body, FIG. 7B is a conceptional sectional side view illustrating a sinking state when a human body lies on a low-resilience elastic body, and FIG. 7C is a conceptional sectional side view illustrating a sinking state (C) when a human body lies on a tactile layer elastic body.

As shown in FIG. 7A, on the high-resilience elastic body (abbreviated as "high-resilience layer"), the sinking displacement of the buttocks is substantially equal to the sinking displacement of the shoulder and the sinking displacement of the heels, a thickness d2 under the buttocks compressed by supporting the body is substantially equal to a thickness d1 under the shoulder and a thickness d3 under the heels (d1≈d2≈d3). Although the sinking displacement of the buttocks is smaller as compared with the sinking displacements of the shoulder and the heels, the contact area between the high-resilience elastic body and the body is small and the area where the high-resilience elastic body upper surface and the body are not in contact is large.

As shown in FIG. 7B, on the low-resilience elastic body (abbreviated as "low-resilience layer"), the sinking displacement of the shoulder and the sinking displacement of the heels are small and the sinking displacement of the buttocks is large. Thus, the thickness d2 of the low-resilience layer under the shoulder and the thickness d3 thereof under the heels are larger than the thickness d2 thereof under the buttocks so that the body sinks in a V-shape.

As shown in FIG. 7C, when the tactile layer 2 is composed of an ultra-low-resilience layer, the sinking displacement of the shoulder, the sinking displacement of the buttocks, and the sinking displacement of the heels are all large on a hard board which is an elastic body, and the thickness d1 of the tactile layer 2 under the shoulder, the thickness d2 thereof under the buttocks, and the thickness d3 thereof under the heels are substantially equal (bottoming state). However, the contact area between the hard board and the body in the tactile layer 2 is large, and a bottoming state is given in which the area where the hard board upper surface and the body are in contact in the tactile layer 2 is large. The difference between the thickness d1 and the thickness d2 and the difference between the thickness d2 and the thickness d3 are preferably 10 mm or less, and further preferably 5 mm or less.

In contrast, the mattress 1 according to the embodiment has heat retention, moisture retention, and sense of embrace without generating a gap between the body and the tactile layer 2, and can provide a feeling in bed superior in body pressure dispersibility without bottoming feeling.

The mattress 1 of the invention can be used as, in addition to a mattress for a bed, a cushioning material for a sofa bed, a chaise longue bed, or similar sofas.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

REFERENCE SIGNS LIST

1 Mattress
2 Tactile layer
3 Cushion layer
4 Cover layer
5, 6 Heat retention cloth layer
31 First cushion layer
32 Second cushion layer

The invention claimed is:

1. A mattress, comprising:

a tactile layer that is positioned on an upper side in use, and a cushion layer that is positioned on a lower side in use, the tactile layer and the cushion layer containing a first elastic body and a second elastic body, respectively, the first elastic body and the second elastic body include a filament three-dimensional assembly, the first elastic body having a thickness of 8 mm or more and 30 mm or less, the second elastic body having a thickness of 50 mm or more and 250 mm or less, wherein when a circular plate with a diameter of 150 mm is placed on an upper surface of the first elastic body, and a load required to move the circular plate downward by 7.5 mm is defined as a resiliency of the first elastic body, the first elastic body has a resiliency of 10 N or more and 80 N or less, and the second elastic body has a resiliency of 100 N or more and 200 N or less.

2. The mattress according to claim 1, wherein the first elastic body is a filament three-dimensional assembly formed of a styrene-based elastomer.

3. The mattress according to claim 1, wherein the second elastic body is a filament three-dimensional assembly formed of a polyester-based elastomer.

4. A method for producing a mattress, the mattress including a tactile layer that is positioned on an upper side in use, and a cushion layer that is positioned on a lower side in use, the tactile layer and the cushion layer containing a first elastic body and a second elastic body, respectively, the first elastic body and the second elastic body include a filament three-dimensional assembly, the first elastic body having a thickness of 8 mm or more and 30 mm or less, the second elastic body having a thickness of 50 mm or more and 250 mm or less, wherein when a circular plate with a diameter of 150 mm is placed on an upper surface of the first elastic body, and a load required to move the circular plate downward by 7.5 mm is defined as a resiliency of the first elastic body, the first elastic body has a resiliency of 10 N or more and 80 N or less, the second elastic body has a resiliency of 100 N or more and 200 N or less, the method comprising:

selecting, as the first elastic body, an elastic body that provides a difference in sinking displacement between a shoulder and a buttocks of 0 mm or more and 5 mm or less when a user lies in a spine position on the first elastic body.

* * * * *